United States Patent [19]

Crosby

[11] Patent Number: 5,058,226

[45] Date of Patent: Oct. 22, 1991

[54] NEWBORN CAR SEAT BLANKET

[76] Inventor: Catherine Crosby, 1080 Calkins Rd., Rochester, N.Y. 14623

[21] Appl. No.: 594,119

[22] Filed: Oct. 9, 1990

[51] Int. Cl.[5] ..... A47G 9/02

[52] U.S. Cl. ..... 5/494; 5/482; 2/69

[58] Field of Search ..... 5/482, 485, 494, 424; 2/69, 69.5; 128/872, 873, 882

[56] References Cited

U.S. PATENT DOCUMENTS

| | | | |
|---|---|---|---|
| 1,584,853 | 5/1926 | Dern | 2/69 |
| 3,962,738 | 6/1976 | Menditto | 5/494 |
| 4,172,300 | 10/1979 | Miller | 5/494 |
| 4,773,101 | 9/1988 | Kapp | 2/69.2 |

OTHER PUBLICATIONS

Campmor catalogue, p. 26, Winter 1989.

*Primary Examiner*—Gary L. Smith
*Assistant Examiner*—F. Saether

[57] ABSTRACT

A baby's receiving blanket includes a back panel and two front pieces together forming a front panel. The back panel and front panel each include a notch in its bottom portion, forming separate leg portions. The front panel further includes a fly adapted to open and close. The front and back panels together form a two-legged pouch for a baby's legs and body. The back panel is larger than the front panel to wrap around and over the baby after it is positioned in the pouch.

2 Claims, 1 Drawing Sheet

NEWBORN CAR SEAT BLANKET

BACKGROUND INFORMATION

This invention is a receiving blanket with pouches for a baby's legs and feet, especially for newborn babies being transported in a car seat when it is necessary to attach a seat belt between the baby's legs.

All babies are wrapped in a receiving blanket when they are discharged from a hospital. Newborn babies need to be wrapped to keep them feeling secure and to protect them from the wheather. The standard receiving blanket simply wraps a baby up in a roll, with the babys body, arms, and legs undifferentiated.

State laws in most if not all of the United States now require that children riding in automobiles be secured in their seats by seat belts. Babies and toddlers usually ride in a "car seat", a removable accessory seat which is supported by the automobile seat and backrest. Most car seat designs require that a baby's legs be separated to accommodate the seat belt.

The standard receiving blanket of the prior art thus creates a dilemma. To comply with seat belt requirements, and to accommodate a seat belt, the standard blanket must be partially removed and the baby's legs exposed, thereby negating much of the benefit of the receiving blanket.

It is therefore an object of this invention to provide a receiving blanket with pouches for a baby's legs and feet so that a car seat belt can be attached between the baby's legs with the blanket fully in place, i.e. without unwrapping the blanket. Thus the car seat belt and the receiving blanket can be used together, and both can be properly used so that one does not negate or interfere with the other.

SUMMARY OF THE INVENTION

In summary, the present invention is a receiving blanket for a baby including a back panel and two front pieces together forming a front panel. The back panel and front panel each include a notch in its bottom portion, forming separate leg portions. The front panel further includes a fly adapted to open and close. The front and back panels together form a two-legged pouch for a baby's legs and body. The back panel is larger than the front panel to wrap around and over the baby after it is positioned in the pouch.

DRAWING

FIG. 4 shows my blanket asembled with the pieces cut from FIG. 1.

DESCRIPTION

Figure 1:
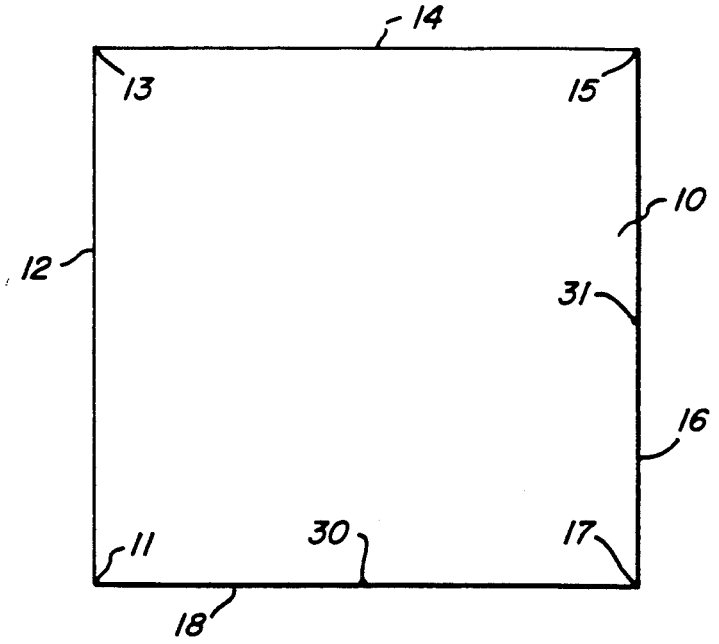
FIG. 1 shows a piece of fabric from which my blanket is made.

The following description is given with reference to the drawing. FIG. 1 shows a rectangular piece of fabric 10 with right and left edges 12 and bottom and top edges 14. The piece is 30" wide, rolled from a standard bolt of fabric. The piece 10 is cut along a first cut line 16 parallel to the right edge 12, leaving a remnant 20 and a main piece 30 which is now 30"×30 41 square (the selvage 13 is also removed). The main piece 30 is next cut along a second cut line 18. The main piece 30 becomes the back piece of the assembled blanket in FIG. 4.

Figure 2:
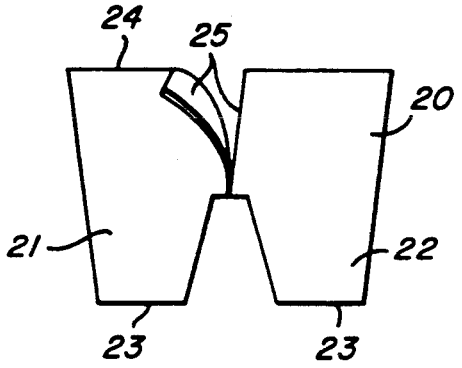
FIG. 2 shows a piece cut from the right side of FIG. 1 and folded over.
Figure 3:
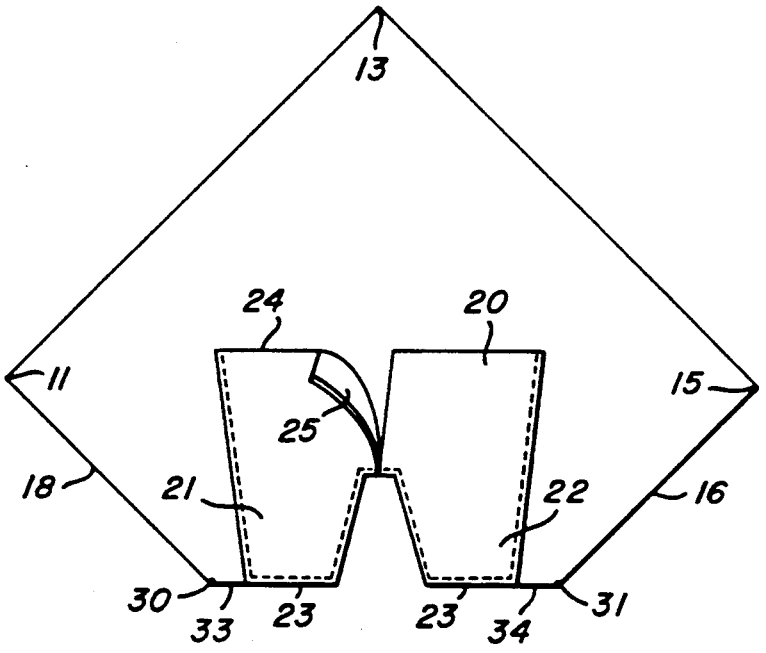
FIG. 3 shows a piece cut from FIG. 2.

In FIG. 2 the remnant 20 is folded in half on a fold line 22, then cut along the fold line 22 and along cut lines 24, 26, 28 to form two identical front pieces 40, shown one atop another in FIG. 3.

FIG. 4 shows the assembled blanket, including the back piece or panel 30 and two front pieces 40 together forming a front panel 50. The back panel 30 includes a notch 32 in its bottom portion, forming separate leg portions. Similarly, the front panel 50 formed by the front pieces 40 includes a notch 52 in its bottom portion, forming separate leg portions. The front panel 50 formed by the pieces 40 further includes a fly 54 adapted to open and close. The front and back panels together form a two-legged pouch for a baby's legs and body. The back panel 30 is larger than the front panel 50 to wrap around the baby after it is positioned in the pouch. The side corners 34 and 36 are brought across the baby, and the top corner 38 is placed over the baby's head as needed.

The foregoing description of a preferred embodiment of this invention, including any dimensions, angles, numbers, or proportions, is intended as illustrative. The concept and scope of the invention are limited only by the following claims and equivalents thereof.

I claim:

1. A receiving blanket for an infant, said blanket including a back panel and a front panel;

said back panel being a generally square piece truncated by a diagonal cut from an intermediate point on one edge thereof to an intermediate point on an adjacent edge thereof; said diagonal cut forming the bottom edge of said back piece, said back panel being further cut upward from the bottom edge thereof to form separate leg portions of said back panel;

said front panel being cut upward from the bottom edge thereof to form separate leg portions of said front panel, said front panel being further cut downward from the top edge thereof to form a fly adapted to open and close;

said front and back panels, with their leg portions contraposed, together forming a two-legged pouch for the legs and body of an infant;

said back panel being larger than said front panel, the side and top corner portions of said back panel adapted to enfold an infant positioned in said pouch.

2. A receiving blanket for an infant, said blanket including a back panel and a front panel;

said back panel being a generally square piece truncated by a diagonal cut from an intermediate point on one edge thereof to an intermediate point on an adjacent edge thereof, said diagonal cut forming the bottom edge of said back piece and leaving side and top corner flap portions, said back panel being further cut upward from the bottom edge thereof to form separate leg portions of said back panel;

said front panel being cut upward from the bottom edge thereof to form separate leg portions of said front panel being further cut downward from the edge thereof to form a fly adapted to open and close;

said front and back panels, with their leg portions contraposed, together forming a two-legged pouch for the legs and body of an infant;

said back panel being larger than said front panel, said side and top corner flap portions of said back panel adapted to enfold an infant positioned in said pouch.

* * * * *

UNITED STATES PATENT AND TRADEMARK OFFICE

CERTIFICATE OF CORRECTION

PATENT NO. : 5,058,226

DATED : Oct. 22, 1991

INVENTOR(S) : Catherine Crosby

It is certified that error appears in the above-identified patent and that said Letters Patent is hereby corrected as shown below:

On the title page, ABSTRACT, lines 1-9, should be deleted and substitute therefor the following:

A baby's receiving blanket includes a back panel and a front panel. Back and front panels each include a notch in its bottom portion, forming separate leg portions. The front panel further includes a fly adapted to open and close. Front and back panels together form a two-legged pouch for a baby's legs and body. The back panel is larger than the front panel to wrap around and over the baby after it is positioned in the pouch.

Column 1, lines 37-68 and column 2, lines 1-20, should be deleted and substitute therefor the following:

Summary of the Invention

In summary, the present invention is a receiving blanket for a baby, including a back panel and a front panel. Back and front panels each include a notch in its bottom portion, forming separate leg portions. The front panel further includes a fly adapted to open and close. Front and back panels together form a two-legged pouch for a baby's legs and body. The back panel is larger than the front panel to wrap around and over the baby after it is positioned in the pouch.

UNITED STATES PATENT AND TRADEMARK OFFICE

CERTIFICATE OF CORRECTION

PATENT NO. : 5,058,226

DATED : Oct. 22, 1991

INVENTOR(S) : Catherine Crosby

It is certified that error appears in the above-identified patent and that said Letters Patent is hereby corrected as shown below:

Drawing

Figure 1 shows a piece of fabric for the back panel of my blanket.

Figure 2 shows the front panel of my blanket.

Figure 3 shows the asembled blanket.

Description

Figure 1 shows a rectangular piece of fabric 10 with edges 12,14, 16, 18, and corners 11, 13, 15, 17. The piece is preferably a 30" x 30" square, and becomes the back panel of the assembled blanket.

Figure 2 shows the front panel 20 of the blanket, cut upward from its bottom edge 23 as shown to form separate leg portions 21 and 22. The front panel 20 is further cut down the middle from its top edge 24 to form a fly 25 which is adapted to open and close.

UNITED STATES PATENT AND TRADEMARK OFFICE

CERTIFICATE OF CORRECTION

PATENT NO. : 5,058,226

DATED : Oct. 22, 1991

INVENTOR(S) : Catherine Crosby

It is certified that error appears in the above-identified patent and that said Letters Patent is hereby corrected as shown below:

In Figure 3, the back panel 10 is rotated clockwise 45° from its Figure 1 orientation. A diagonal cut is made from an intermediate point 30 on the edge 18 to an intermediate point 31 on the adjacent edge 16. Intermediate points 30 and 31 may be the center points of their respective edges 18 and 16, as illustrated. The back panel 10 is further cut as indicated to form separate leg portions 33 and 34. The term "diagonal" herein means parallel to a line joining opposite vertices.

UNITED STATES PATENT AND TRADEMARK OFFICE

CERTIFICATE OF CORRECTION

PATENT NO. : 5,058,226

DATED : Oct. 22, 1991

INVENTOR(S) : Catherine Crosby

It is certified that error appears in the above-identified patent and that said Letters Patent is hereby corrected as shown below:

Figure 3 shows the assembled blanket, with the front panel 20 sewn to the back panel 10, their leg portions being in registry. The front and back panels together form a two-legged pouch for a baby's legs and body. The back panel 10 is larger than the front panel 20, to wrap around the baby after it is positioned in the pouch. The side corners 11 and 15 are brought across the baby, and the top corner 13 is placed over the baby's head as needed.

Signed and Sealed this

Twenty-ninth Day of June, 1993

*Attest:*

*Attesting Officer*

Michael K. Kirk

MICHAEL K. KIRK

*Acting Commissioner of Patents and Trademarks*